United States Patent [19]

Bath

[11] 4,156,216

[45] May 22, 1979

[54] MERCURY SWITCH RELAY

[75] Inventor: Jerome R. Bath, Greenfield, Wis.

[73] Assignee: Allen-Bradley Company, Milwaukee, Wis.

[21] Appl. No.: 839,984

[22] Filed: Oct. 6, 1977

[51] Int. Cl.[2] ..... H01H 29/00; H01H 51/22

[52] U.S. Cl. ..... 335/51; 335/85

[58] Field of Search ..... 335/205, 51, 57, 58, 335/84, 85, 86, 236, 152

[56] References Cited

U.S. PATENT DOCUMENTS

| | | | |
|---|---|---|---|
| 2,508,508 | 5/1950 | Garvin | 335/51 |
| 3,605,049 | 9/1971 | Wielebski | 335/58 |
| 3,646,490 | 2/1972 | Bitko | 335/152 |

*Primary Examiner*—Harold Broome

*Attorney, Agent, or Firm*—Quarles & Brady

[57] ABSTRACT

A mercury switch is provided in a cartridge for insertion into a relay having a plurality of flux fingers spaced apart to define a flux finger gap, the cartridge being received in the relay and bridging the flux finger gap. The mercury switch includes a pair of mercury layers having an air gap therebetween, the mercury layers merging in response to a magnetic field to form a continuous electrical conductor. The mercury switch is disposed across the width of the cartridge in the flux finger gap. Flux plates are disposed within the cartridge and magnetically coupled to the switch to provide a low reluctance path between the flux fingers, the path including the switch air gap. The switch may be operated in a normally open position; or with the insertion of a bias magnet in the cartridge, the switch may be operated in a normally closed position.

7 Claims, 5 Drawing Figures

MERCURY SWITCH RELAY

BACKGROUND OF THE INVENTION

The field of the invention is electrical relays having a plurality of magnetically responsive sealed switches of the type which are known for their high reliability, speed of operation and use in adverse operating environments. In this category of switches are the basic dry reed switch and the many variations thereof. A typical relay using reed switches is described in U.S. Pat. No. 3,605,049.

The basic dry reed switch includes a pair of elongated, overlapping reed members which act as both current and flux conductors. The reeds are usually enclosed in a sealed glass envelope filled with an inert gas. When flux flows across the gap between the overlapping reed members, they are pulled together to make electrical contact.

The reed switch is reliable and simple; however, it exhibits the phenomenon known as "contact bounce." When a reed switch is actuated, the contacts close, separate a short distance, and then close again, all within a period from 100 to 400 microseconds after the initial closure. Bounces are recorded on an oscilloscope as a series of high level pulses of short duration. This feature is undesirable because such pulses may falsely trigger solid state digital circuitry. Contact bounce also generates some radio frequency interference, and is responsible for arcing which causes pitting and wear on the switch contacts.

The present invention employs a mercury switch which includes two mercury layers wetting its inner surfaces, one of the layers being movable toward the other in response to an external magnetic field to form a continuous volume of mercury that conducts electricity. Upon removal of the external magnetic field, the movable layer returns to its normal position breaking a filament of mercury drawn from the mercury layer wetting the other surface. As applied to mercury the term "layer" is distinguishable from the terms "pool" and "film." This distinction is explained in U.S. Pat. No. 3,646,490 entitled "Mercury Switch."

SUMMARY OF THE INVENTION

The invention includes an elongated cartridge which is disposed in a relay having a pair of flux fingers spaced apart to define a flux finger gap, the cartridge being disposed in the relay and bridging the flux finger gap, the cartridge having a cavity therein, a mercury switch disposed in the cartridge cavity in the flux finger gap, and a pair of flux plates extending inwardly from opposite sides of the flux finger gap, each flux plate being magnetically coupled to one of the flux fingers at one end and being magnetically coupled to the switch at the other end to form a low reluctance path across the flux finger gap.

The general object of the invention is to provide an improved sealed switch relay with performance features of particular benefit when applied to low signal level, digital circuitry. Specific objects of the invention are: to eliminate contact bounce, to eliminate contact wear and to maintain more constant contact resistance in a sealed contact relay.

A further specific object of the invention is to provide a mercury switch cartridge which can be operated with a normally closed switch. This is accomplished by positioning a permanent magnet in the cartridge to bias the switch. Other features, objects and advantages of the invention will become apparent from the description to follow.

DESCRIPTION OF THE PREFERRED EMBODIMENT

Figure 1:
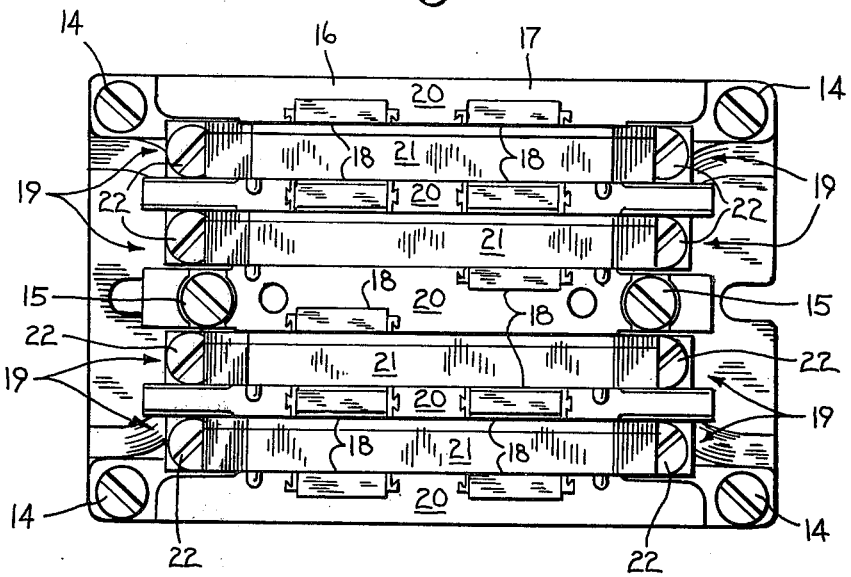
FIG. 1 is a top plan view of a sealed contact relay incorporating the elements of the invention.
Figure 2:
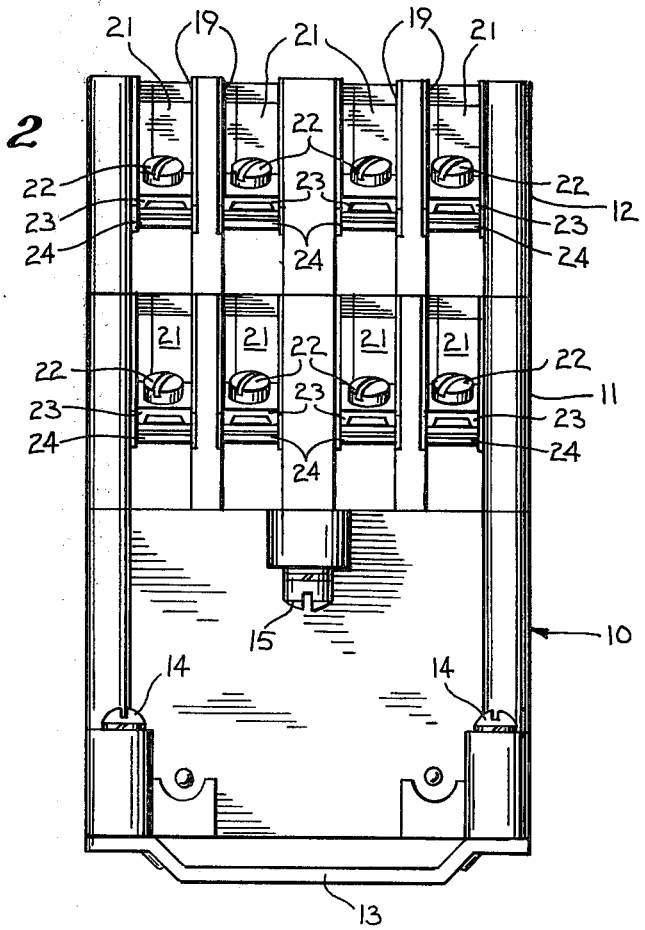
FIG. 2 is a side elevation view of the same embodiment of the invention.

As seen in FIGS. 1 and 2, the relay which incorporates the present invention is a generally rectangular structure including an energizing section 10, and two switch sections 11, 12. The energizing section 10 is attached to a mounting frame 13 by means of four screws 14. The two switch sections 11, 12 are stacked on top of the energizing section 10 and held in place by bolts 15. A complete description of the construction and operation of the relay except for the switch cartridge of the present invention is provided in U.S. Pat. No. 3,605,049.

The present invention is concerned with the two flux finger sets 16, 17, each having five bar-shaped flux fingers 18, which provide a low reluctance path for magnetic flux originating in the energizing section 10 and flowing through the flux fingers 18 to elongated channels 19 formed in the switch sections 11, 12. The channels 19 extend from beyond the flux finger array on one side through a first flux finger set 16, across a flux finger gap 20, through a second flux finger set 17 and beyond the flux finger array on the other side.

The switch sections 11, 12 each contain four elongated cartridges 21. Each cartridge 21 fits snugly within a channel 19 in its respective switch section. A wire terminal is formed at each end of the cartridge 21 by a screw 22 cooperating with a wire clamp 23 and a contact flange 24.

Figure 3:
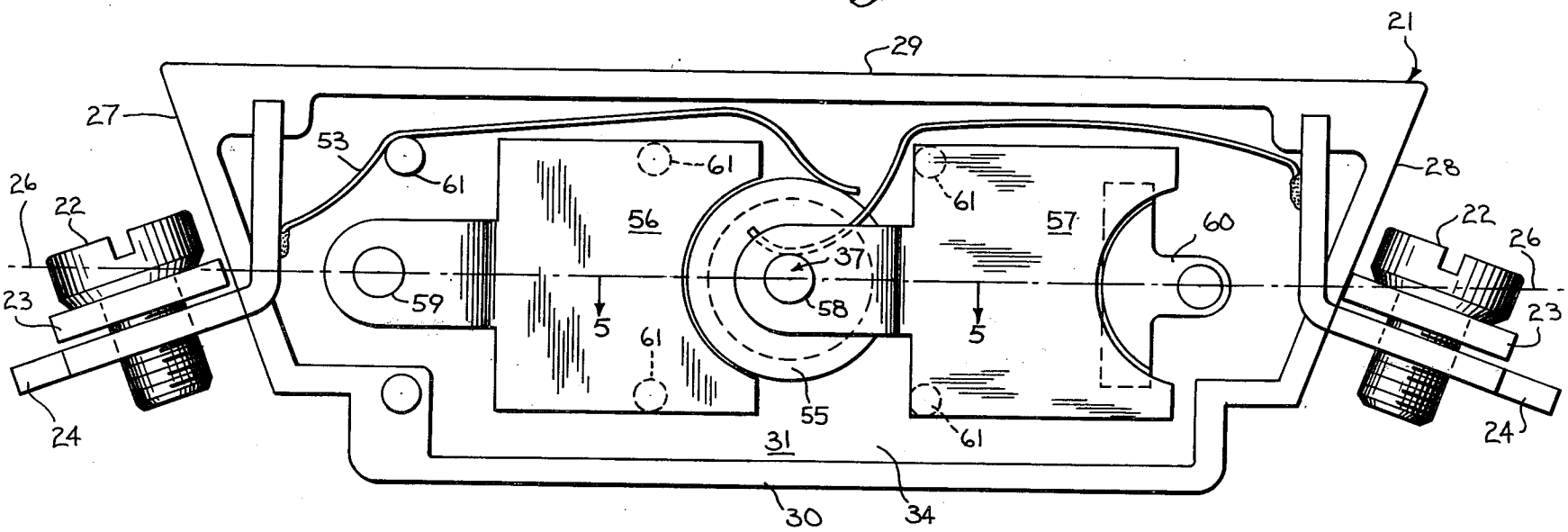
FIG. 3 is a side elevation view of the switch cartridge of FIGS. 1 and 2 with a side wall removed.
Figure 4:
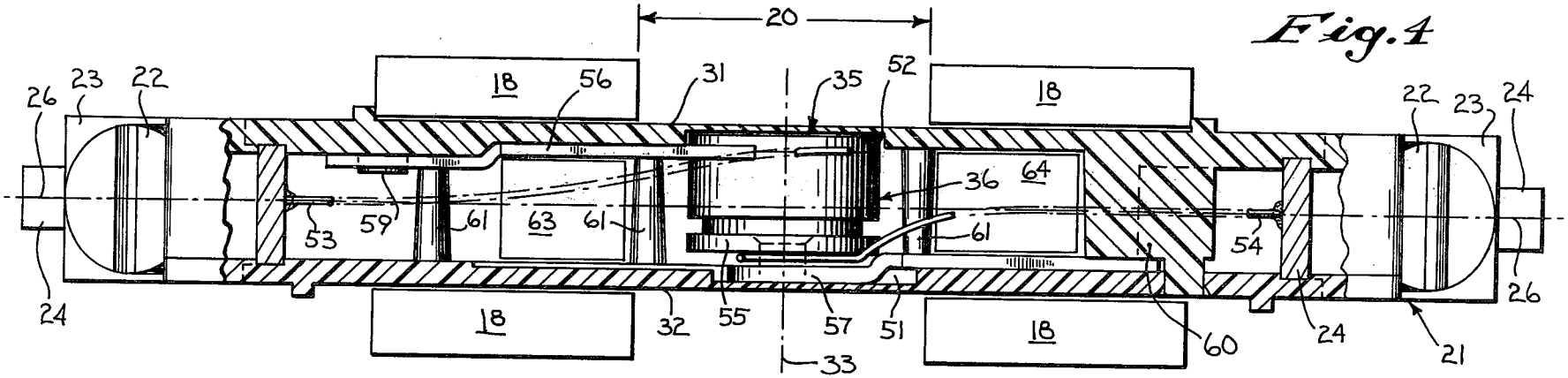
FIG. 4 is a top plan view of the switch cartridge of FIGS. 1 and 2 having a top wall cut away.

As shown in FIGS. 3 and 4, each cartridge 21 is formed about a longitudinal axis 26 which is defined by a line which extends between two end walls 27, 28 of the cartridge 21, running approximately midway between top and bottom walls 29, 30 and running approximately midway between first and second side walls 31, 32 of the cartridge 21. A transverse axis 33 is defined by a line which is substantially perpendicular to the side walls 31, 32 of the cartridge 21, and which intersects the longitudinal axis 26 approximately midway between the end walls 27, 28. The cartridge walls 27–32 define a cartridge cavity 34 in which a mercury switch 35 is disposed.

The mercury switch 35 of the present invention is an attitude insensitive switch of the type disclosed in U.S. Pat. No. 3,646,490 which is commercially available. As shown best in FIG. 5, the mercury switch 35 includes a head 36 and a pole piece 37. The head 36 is mounted on the pole piece 37 with an insulating ring-shaped connector 38. The head 36 includes a base 39, a movable armature 40 mounted on the base 39, and a cap 41 which holds the armature 40 in place. A mercury contact chamber 42 is formed by the base 39 and the armature 40. A damper chamber 43 is formed by the cap 41 and the armature 40. The pole piece 37 includes a jacket 44 and a core 45, the upper end of the pole piece 37 extending into the mercury contact chamber 42. A mercury layer 46 is provided in the mercury contact chamber 42 at the tip of the core 45. Another mercury layer 47 is provided in the mercury contact chamber 42 on one surface of the armature 40 and on the inner surface of the base 39 with the exception of the insulating connector 38, which is non-wettable. This layer extends through capillary grooves in the armature into the damper chamber 43 and wets the inner surfaces of the cap 41. A non-wettable damper 48 is disposed in the damper chamber 43 to damp the movement of the armature 40. An air gap 49 exists between the two mercury layers 46, 47.

A switch axis 50 is defined by a line which extends from the center of the top surface of the head 36 to the center of the bottom surface of the pole piece 37 intersecting the mercury layers 46, 47 at substantially a right angle and crossing the air gap 49 between them. Preferably, the head 36 and the pole piece 37 are both cylindrical; and preferably the switch 35 is formed symmetrically about the switch axis 50; but the invention is not limited to use of a switch of any particular shape or a switch which is symmetrical about the switch axis 50 as defined.

The mercury switch 35 is operated by inducing a magnetic field in the air gap 49 between the mercury layers 46, 47 and substantially along the switch axis 50, causing the armature 40 to flex, reshaping its mercury layer 47 so that it merges with the mercury layer 46 disposed on the tip of the pole piece 37. The two mercury layers merge to form a continuous electrical conductor about the switch axis 50. Upon removal of the external magnetic field the armature 40 returns to its normal position breaking a filament of mercury drawn from the mercury conductor. As the mercury is depleted in the area where the layers merge, the required mercury is replenished from the wetted surfaces in the two mercury chambers 42, 43 until a condition of equilibrium is reached.

As shown in FIG. 4, the mercury switch 35 is mounted in the cartridge 21 with its switch axis 50 substantially in alignment with the transverse axis 33. The pole piece 37, which is usually longer in proportion to the head 36 when obtained from commercial sources, has been shortened to fit the mercury switch 35 across the width of the cartridge 21. The side walls 31, 32 each have a recess 51, 52 which slightly increases the width of the cartridge cavity 34 across the transverse axis 33 where the switch 35 is disposed. One electrical lead 53 is soldered or otherwise connected to the head 36 at one end and to a contact flange 24 at the other end. Another electrical lead 54 is soldered or otherwise connected to the pole piece 37 at one end and to a contact flange 24 at the opposite end of the cartridge 21. An insulating bushing 55 is mounted on the pole piece between the head 36 and the electrical connection to the pole piece 37.

A pair of flux plates 56, 57 are positioned on opposite sides of the switch 35. The flux plates 56, 57 are made of a ferromagnetic material and are identically formed having a curved edge segment at one end which will receive the head 36 and having a hole 58 at the other end to receive the pole piece 37. A first flux plate 56 is mounted on a first flux plate support 59 on one side of the switch 35 and outside the flux finger gap 20 and extends inward to contact the head 36 of the switch 35 at the other end. A second flux plate 57 is mounted on a second flux plate support 60 on the opposite side of the switch 35 and outside the flux finger gap 20 and extends inward to contact the pole piece 37 of the switch 35. The first flux plate support 59 is a stud which extends from the first side wall 31 and which is received in the hole 58 of the first flux plate 56. The second flux plate support 60 is a T-shaped projection having a crosspiece with ends that are recessed about a raised uppermost portion having a curved edge. The second flux plate 57 is supported on the recessed ends, its curved edge segment fitting together with the raised edge of the second flux plate support 60. A set of posts 61 are disposed between the cartridge side walls to hold the flux plates 56, 57 in place on the flux plate supports 58, 59.

The flux in the channel 19 is generally distributed parallel to the longitudinal axis 26 of the cartridge 21 and perpendicular to the switch axis 50. The switch 35 is operated by flux that flows between the two mercury layers 46, 47 and across the air gap 49. This flux "links" the air gap 49. With the switch 35 located in the flux finger gap 20, a large part of the flux flowing between the flux fingers 18 in the channel 19 is not linked to the air gap 49. On the other hand, positioning the flux plates 56, 57 along the longitudinal axis 26 would link so much flux to the air gap 49 that the switch 35 would be extremely sensitive. Therefore, the flux plates 56, 57 are each positioned between the longitudinal axis 26 and a respective one of the side walls 30, 31.

Figure 5:
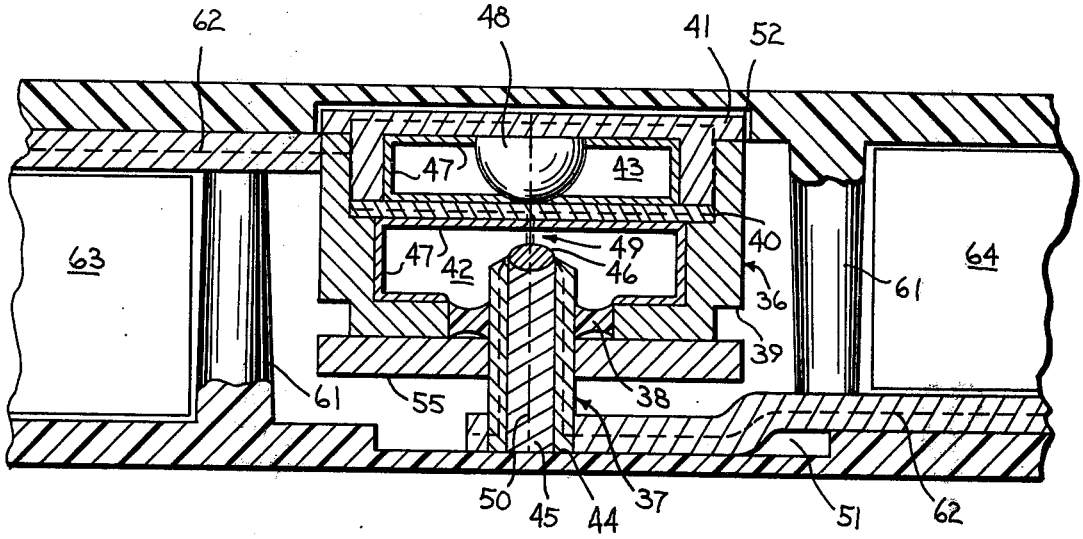
FIG. 5 is a sectional view of a mercury switch and the flux plates of the invention taken along the lines indicated in FIG. 3.

The flux plates 56, 57 combine with the switch 35 to form a low reluctance path between two flux fingers 18, generally along the lines 62 indicated in FIG. 5. The head 36 and the pole piece 37 provide the portion of the path between the flux plates 56, 57 and the mercury layers 46, 47. The last portion of the path is provided by the mercury layers 46, 47 and the air gap 49.

With sufficient flux linked to the air gap 49 through the low reluctance path 62, the switch 35 may be operated by adjusting the magnitude of the flux. With no flux across the air gap 49 the switch 35 is open; a small residual flux in the flux fingers 18 does not change this condition. A sufficient increase in the magnitude of the flux closes the switch 35. A corresponding decrease in flux reopens the switch 35.

The switch mounted in a relay cartridge as described above will operate as a normally open relay switch. The invention may be also practiced with a normally closed relay switch by mounting permanent bias magnets 63 and 64 in the cartridge cavity 34. The bias magnets 63, 64 are positioned immediately next to the flux plates 56, 57 substantially filling the cartridge cavity 34 between the side walls 31, 32 and between the top and bottom walls 29, 30 of the cartridge 21 along a portion of each flux plate 56, 57. The bias magnets 63, 64 provide flux to maintain the continuous conductor between the mercury layers 46, 47. When overcome by sufficient flux of opposite polarity flowing from the flux fingers 18 the mercury switch 35 will be opened.

Although the invention has been described with reference to one embodiment, it will be understood by those skilled in the art that the invention is capable of a variety of alternative embodiments, many of which are suggested in this disclosure, and reference should be made to the following claims for the scope of the invention.

I claim:

1. In a relay having flux-generating means and a pair of flux fingers magnetically coupled to the flux-generating means to receive flux therefrom, the flux fingers being spaced apart to define a flux finger gap, the combination comprising:

an elongated cartridge which is disposed in the relay and which bridges the flux finger gap, the cartridge having a cavity therein;

a mercury switch disposed in the cartridge cavity in the flux finger gap, the mercury switch including an air gap and being operable by flux directed across the air gap; and a pair of flux plates disposed in the cartridge cavity and extending inwardly from opposite sides of the flux finger gap, each flux plate having one end magnetically coupled to one of the flux fingers and having another end magnetically coupled to the switch on a respective side of the air gap, thereby forming a low reluctance path which extends from the flux-generating means, across the flux finger gap and through the switch air gap.

2. The combination as recited in claim 1, further comprising a permanent magnet disposed in the cartridge cavity next to one of the flux plates, so that flux produced by the permanent magnet is coupled across the switch air gap to bias the switch to operate in a normally closed position.

3. The combination as recited in claim 1, wherein:

the mercury switch includes a head and a pole piece extending from the head and insulatedly connected thereto, the head and pole piece forming a pair of electrical and magnetic contacts on opposite sides of the switch air gap; and further comprising a pair of wire terminals mounted on the cartridge; and further comprising a pair of electrical leads, one of the leads connected between one of the wire terminals and the switch head, and the other of the leads connected between the other of the wire terminals and the switch pole piece; and further comprising insulating means mounted on the switch pole piece between the switch head and the lead connected to the switch pole piece.

4. In a sealed contact relay having an energizing section, and two flux finger sets magnetically coupled to the energizing section to receive flux therefrom, the sets being spaced apart to define a flux finger gap therebetween, and each set having a plurality of spaced parallel flux fingers which are aligned with the flux fingers in the other set to form a plurality of channels, the combination comprising:

a cartridge which is disposed in one of the channels and which bridges the flux finger gap, the cartridge including first and second end walls and first and second side walls spaced apart to define a cavity therebetween;

a mercury switch disposed in the cartridge cavity and including a chamber in which a movable, magnetically operable armature and a pair of mercury layers are disposed, the mercury layers having an air gap therebetween, one mercury layer being disposed on the armature and moved therewith in response to a change of flux across the air gap to open or close an electrical circuit;

electrical connector means mounted on the cartridge and extending into the cartridge cavity for electrically connecting the switch to an external circuit; and a pair of flux plates, a first flux plate disposed in the cartridge cavity and extending inward from one side of the flux finger gap to magnetically couple with the switch on one side of the switch air gap, and a second flux plate disposed in the cartridge cavity and extending inward from the other side of the flux finger gap to magnetically couple with the switch on the other side of the switch air gap, the flux plates and the switch forming a low reluctance path between the two flux finger sets and across the switch air gap.

5. The combination as recited in claim 4, wherein:

the cartridge has a longitudinal axis which extends from the first end wall to the second end wall and a transverse axis which is substantially perpendicular to the longitudinal axis and which extends from the first side wall to the second side wall; and wherein the switch has its air gap disposed along a switch axis, and the switch is disposed in the cartridge cavity with its switch axis substantially in alignment with the transverse axis.

6. The combination of claim 5 wherein the flux plates are disposed on opposite sides of the longitudinal axis of the cartridge.

7. The combination as recited in claim 4, further comprising:

a permanent magnet disposed in the cartridge cavity next to one of the flux plates, so that flux produced by the permanent magnet is magnetically coupled through the flux plate to hold the switch armature in a normally closed operating position.

* * * * *